US012474065B2

(12) United States Patent
Batek et al.

(10) Patent No.: US 12,474,065 B2
(45) Date of Patent: Nov. 18, 2025

(54) VENTILATION SYSTEM FOR A HOUSEHOLD APPLIANCE

(71) Applicant: WHIRLPOOL CORPORATION, Benton Harbor, MI (US)

(72) Inventors: Andrew Batek, St. Joseph, MI (US); Jason Schneemann, Ann Arbor, MI (US); Nicole Smith, Canton, MI (US); Annie Stuart, St. Joseph, MI (US); Ronald Voglewede, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 777 days.

(21) Appl. No.: 17/673,237

(22) Filed: Feb. 16, 2022

(65) Prior Publication Data

US 2023/0258339 A1 Aug. 17, 2023

(51) Int. Cl.
*F24C 15/20* (2006.01)
*F28D 21/00* (2006.01)

(52) U.S. Cl.
CPC ..... *F24C 15/2035* (2013.01); *F28D 21/0003* (2013.01)

(58) Field of Classification Search
CPC ..... F24C 15/2035
See application file for complete search history.

(56) References Cited

U.S. PATENT DOCUMENTS 4,043,319 A * 8/1977 Jensen ..... B05B 16/60 55/DIG. 36
4,186,727 A * 2/1980 Kaufman ..... F24C 15/20 55/DIG. 36
4,477,019 A 10/1984 Breitbach
4,484,563 A * 11/1984 Fritz ..... F24C 15/20 454/67
4,903,685 A * 2/1990 Melink ..... F24C 15/2021 126/299 D
5,433,377 A 7/1995 Sodo et al.
7,147,168 B1 * 12/2006 Bagwell ..... F24F 11/62 454/343
9,010,019 B2 4/2015 Mittelmark
9,222,680 B1 * 12/2015 Woodall, III ..... F24C 15/20
(Continued)

FOREIGN PATENT DOCUMENTS

CA 2447351 4/2005
CN 102215939 A 10/2011
(Continued)

OTHER PUBLICATIONS

Heat Recovery Ventilators, Natural Resources Canada's Office of Energy Efficiency; Publication Date—2012, 36 Pages.
(Continued)

*Primary Examiner* — Ko-Wei Lin
(74) *Attorney, Agent, or Firm* — McGarry Bair PC

(57) ABSTRACT

A ventilation system for an appliance that generates an exhaust fluid when used. The appliance being provided within an interior of environment. The ventilation system being fluidly coupled to a ventilator operably coupled to the environment. The ventilation system can include a suction source in fluid communication with the appliance and the exhaust fluid, and a duct fluidly coupling the suction source to the ventilator.

12 Claims, 3 Drawing Sheets

(56) References Cited

U.S. PATENT DOCUMENTS

| | | | | |
|---|---|---|---|---|
| 9,803,884 | B2 | 10/2017 | Jung | |
| 10,477,779 | B2 | 11/2019 | Hutzel | |
| 10,576,418 | B2 | 3/2020 | De Paoli et al. | |
| 10,775,071 | B2 | 9/2020 | Dempsey et al. | |
| 10,845,130 | B2 * | 11/2020 | Lambertson | F24C 15/2071 |
| 11,460,196 | B2 * | 10/2022 | Yang | F24C 15/2042 |
| 2002/0017107 | A1 | 2/2002 | Bailey et al. | |
| 2002/0022449 | A1 | 2/2002 | Beaini | |
| 2006/0032492 | A1 * | 2/2006 | Bagwell | F24C 15/2042 126/299 R |
| 2009/0042500 | A1 * | 2/2009 | Robison | B08B 3/02 454/67 |
| 2011/0146941 | A1 | 6/2011 | Benoit et al. | |
| 2011/0284091 | A1 * | 11/2011 | Livchak | F24C 15/2042 126/299 R |
| 2012/0122386 | A1 * | 5/2012 | Uebele | F24C 15/2021 454/67 |
| 2013/0061567 | A1 * | 3/2013 | Kawasaki | B25J 21/02 55/385.2 |
| 2013/0225060 | A1 | 8/2013 | Heberer et al. | |
| 2017/0138612 | A1 | 5/2017 | Kaiser | |
| 2018/0195808 | A1 | 7/2018 | Lambertson | |
| 2019/0063769 | A1 | 2/2019 | Hokanson et al. | |
| 2019/0063780 | A1 | 2/2019 | Puttagunta et al. | |
| 2019/0316807 | A1 | 10/2019 | Singh et al. | |
| 2020/0386415 | A1 * | 12/2020 | Yang | F24C 15/2035 |
| 2021/0215350 | A1 * | 7/2021 | Kim | F24C 15/2042 |
| 2021/0396394 | A1 * | 12/2021 | Woods | F24C 15/2035 |
| 2022/0282873 | A1 * | 9/2022 | Frayer | B01D 46/46 |

FOREIGN PATENT DOCUMENTS

| | | | | |
|---|---|---|---|---|
| CN | 104990113 | A | 10/2015 | |
| CN | 204830075 | U | 12/2015 | |
| CN | 110332645 | A | 10/2019 | |
| EP | 2618067 | A2 * | 7/2013 | F24F 12/006 |
| FI | 125671 | B | 1/2016 | |
| GB | 2578798 | A1 | 5/2020 | |
| RU | 2727286 | C1 | 7/2020 | |
| WO | 1995014196 | A1 | 5/1995 | |
| WO | 2005026624 | A1 | 3/2005 | |
| WO | 2005045325 | A1 | 5/2005 | |
| WO | 2013016824 | A1 | 2/2013 | |

OTHER PUBLICATIONS

Local Exhaust and Whole House Ventilation Strategies, Armin Rudd, Feb. 2011, 46 Pages.

Performance of a Heat Recovery Ventilator Coupled With an Air-To-Air Heat Pump for Residential Suites in Canadian Cities, Bo Li, Peter Wild, Andrew Rowe, Jan. 2019, 7 Pages.

* cited by examiner

VENTILATION SYSTEM FOR A HOUSEHOLD APPLIANCE

BACKGROUND

Appliances, such as a laundry treating appliance, a stovetop range, a microwave, etc., can require a ventilation system to disperse or otherwise direct exhaust fluid away from a user or an interior of an environment that the appliance is provided within. The exhaust fluid can be any suitable fluid that is generated during the normal operation of the appliance. For example, the appliance can be the stovetop range that when in operation generates Volatile Organic Compounds (VOCs) that can be harmful if inhaled by a user within the environment. As such, the VOCs are exhausted away from the user. In the case of the stovetop range, the VOCs can be exhausted away by a range hood including a suction source. The range hood can direct the VOCs away from the user to a location, for example, that is exterior the environment. Ventilation systems for an appliance, however, require direct alteration of the environment in order to function properly. For example, the range hood can require that a hole be cut, and additional elements (e.g., ducts) to be installed within the existing environment. The direct alteration of the environment in order to properly use the appliance can be costly and time consuming.

BRIEF DESCRIPTION

According to an aspect of the present disclosure a ventilation system for an appliance configured to generate a Volatile Organic Compound (VOC) when used, the appliance being provided within an interior of an environment, and configured to be fluidly coupled to a Heating, Ventilation, and Air Conditioning (HVAC) system of the environment, the HVAC system having a ventilator, the ventilation system comprising a suction source in fluid communication with the appliance and configured to draw a mixture of air and VOCs into the ventilation system, and a duct fluidly coupling the suction source to the ventilator, wherein the ventilator of the HVAC system includes one of an Energy Recovery Ventilator (ERV), Heat Recovery Ventilator (HRV), or biological ventilator.

DETAILED DESCRIPTION

Figure 1:
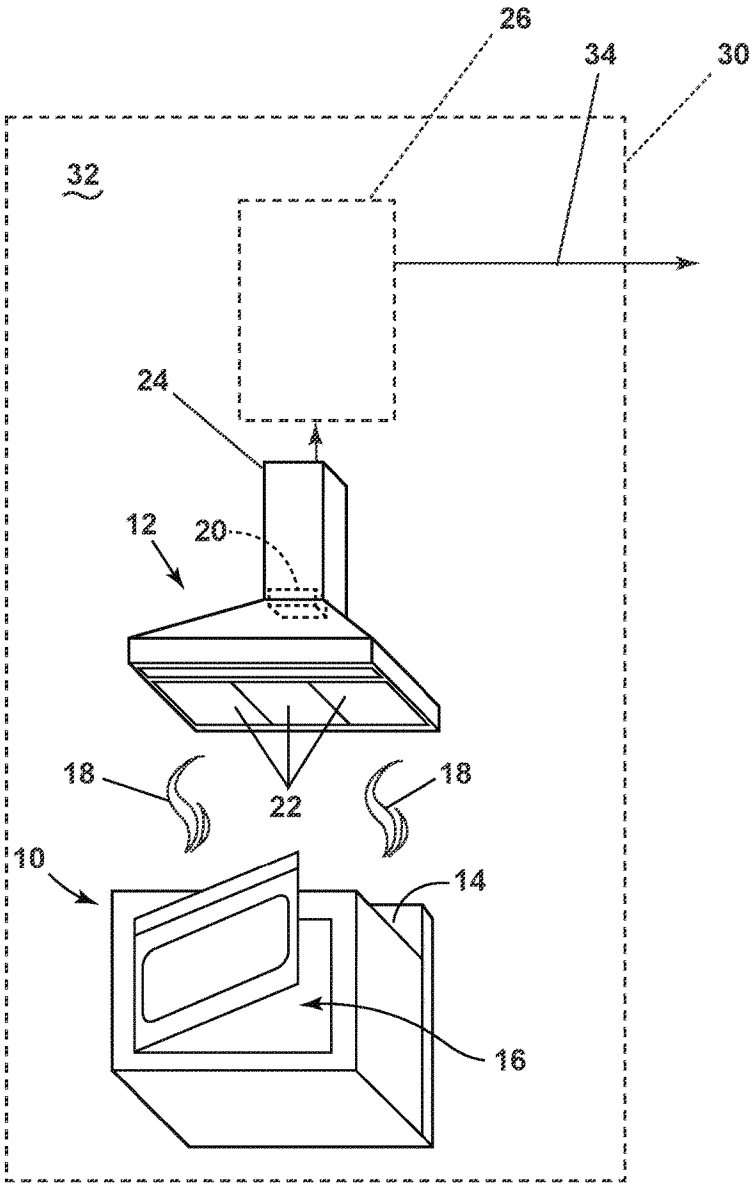
FIG. 1 is a schematic representation of an environment including an appliance and a ventilation system for the appliance, the ventilation system operably coupled to a ventilator.

Aspects of this disclosure relate to an environment including a ventilator operably coupled to a ventilation system for an appliance that is provided within the environment. As a non-limiting example, aspects of this disclosure relate to a household appliance including a stovetop range fluidly coupled to a ventilation system including a range hood. The range hood can be operably coupled to an existing ventilator within the environment or household. During use of the stovetop range, an exhaust fluid can be generated containing VOCs, which can ultimately be exhausted or filtered out of the exhaust fluid by the ventilator. While described in terms of a household appliance including a stovetop range fluidly coupled to a range hood, which is fluidly coupled to an existing ventilator within the household, it will be appreciated that aspects of this discourse can relate to any suitable appliance configured to generate an exhaust fluid, the appliance being provided within any suitable environment including any suitable ventilator. As a non-limiting example, the environment can be any suitable environment such as, but not limited to, a household (e.g., a kitchen, a laundry room, a dining room, a living room, etc.), a retail store, or a restaurant.

As used herein, a "system" or a "controller module" can include at least one processor and memory. Non-limiting examples of the memory can include Random Access Memory (RAM), Read-Only Memory (ROM), flash memory, or one or more different types of portable electronic memory, such as discs, Digital Versatile Discs (DVDs), Compact Disc-Read Only Memory (CD-ROMs), etc., or any suitable combination of these types of memory. The processor can be configured to run any suitable programs or executable instructions designed to carry out various methods, functionality, processing tasks, calculations, or the like, to enable or achieve the technical operations or operations described herein. The program can include a computer program product that can include machine-readable media for carrying or having machine-executable instructions or data structures stored thereon. Such machine-readable media can be any available media, which can be accessed by a general purpose or special purpose computer or other machine with a processor. Generally, such a computer program can include routines, programs, objects, components, data structures, algorithms, etc., that have the technical effect of performing particular tasks or implement particular abstract data types.

Reference will now be made in detail to aspects of the disclosure, one or more non-limiting examples of which are illustrated in the FIGS. Each example is provided by way of explanation of the disclosure, not limitation of the disclosure. In fact, it will be apparent to those skilled in the art that various modifications and variations can be made in the present disclosure without departing from the scope or spirit of the disclosure. Thus, it is intended that the present disclosure covers such modifications and variations as come within the scope of the appended claims and their equivalents.

FIG. 1 is a schematic representation of an environment 30 including an appliance 10 and a ventilation system 12 for the appliance 10. The appliance 10 and the ventilation system 12 can be provided within an interior 32 of the environment. The environment 30 can be any suitable residential or commercial environment as described herein such as, but not limited to, a kitchen, an entire household, or a restaurant. The ventilation system 12 can be directly fluidly coupled to a ventilator 26. The ventilator 26 can be at least a portion of or otherwise form an existing Heating, Ventilation, and Air Conditioning (HVAC) system of the environment 30. The ventilator 26 can be at least partially located within the interior 32. The ventilator 26 can be an existing ventilator within the environment 30.

The appliance 10 is a stovetop range including a stovetop 14 and an interior 16 (e.g., a cooking chamber). The ventilation system 12 is a range hood for the stovetop range including at least on suction source 20. During operation (e.g., cooking of food), the appliance 10 can generated an exhaust fluid 18. The exhaust fluid 18 can be any suitable fluid generated during the operation of the appliances 10. As a non-limiting example, the exhaust fluid 18 can be a mixture of air and VOCs generated during the cooking of food. The suction source 20 can draw the exhaust fluid 18 into the ventilation system 12. While illustrated as a stovetop range, it will be appreciated that the appliance 10 can be any suitable appliance configured to generate an exhaust fluid 18 when operated. As a non-limiting example, the appliance 10 can be the stovetop range, a laundry machine, a microwave, a refrigerator, a coffee machine, a toaster, a grill, or any other suitable appliance. While illustrated as a range hood, it will be appreciated that the ventilation system 12 can be any suitable ventilation system configured to draw in or otherwise be fluidly coupled to the exhaust fluid 18 from the appliance 10. As a non-limiting example, the ventilation system 12 can be the range hood, an exhaust fan, an exhaust duct, or any other suitable ventilation system 12. While illustrated as exterior to the appliances 10, it will be appreciated that the ventilation system 12 can be at least partially formed within or physically coupled to the appliance. As a non-limiting example, the appliances 10 can be a laundry drier and the ventilation system 12 can be a duct/fan provided within a portion of the laundry drier.

The ventilation system 12 can include an element configured to remove at least a portion of VOCs or other compounds from the exhaust fluid 18. As a non-limiting example, the ventilation system 12 can include a filter 22 configured to remove at least a portion of VOCs or other compounds from the exhaust fluid 18. The ventilation system 12 can further include a duct 24 directly fluidly coupling the ventilation system 12 to the ventilator 26. It will be appreciated that the duct 24 can be generally defined as any physical coupling between the ventilation system 12 and the ventilator 26.

During operation of the appliance 10, the exhaust fluid 18 can be generated and provided to or otherwise be drawn in by the ventilation system (e.g., through the suction source 20). The exhaust fluid 18 can be directed through the duct 24 and at least a portion of the ventilator 26. From there, the exhaust fluid 18 can be exhausted through an outlet fluid flow 34 to an area exterior the environment 30. As used herein, the phrase "exterior the environment" or iterations thereof can refer to any location that is not within the interior 32. As a non-limiting example, exterior the environment 30 can be to atmosphere (e.g., outside), to another room, or to another ventilation system (e.g., another duct).

Figure 2:
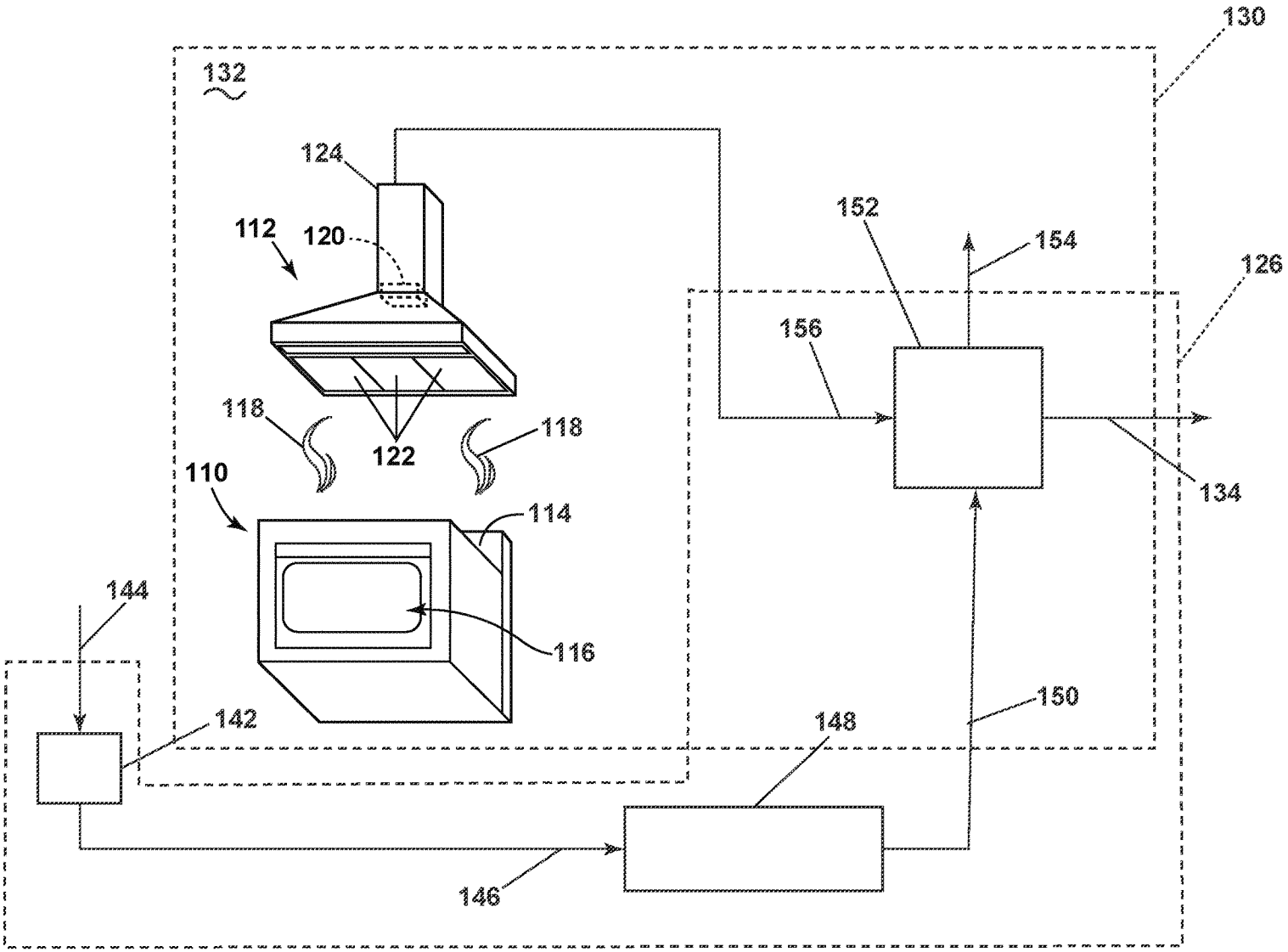
FIG. 2 is a schematic representation of an exemplary environment including an exemplary ventilator suitable for use as the ventilator of FIG. 1, the exemplary ventilator including a first heat exchanger and a second heat exchanger.

FIG. 2 is a schematic representation of an exemplary environment 130 including an exemplary ventilator 126 suitable for use as the ventilator 26 of FIG. 1. The ventilator 126 and the environment 130 are similar to the ventilator 26 and environment 30, respectively, therefore, like parts will be identified with like numerals increased to the 200 series, with it being understood that the description of the like parts of ventilator 26 and the environment 30 applies to the ventilator 126 and the environment 130, respectively, unless otherwise noted.

An appliance 110 and a ventilation system 112 for the appliance 110 can be provided within an interior 132 of the environment 130. The appliance 110, as illustrated, is a stovetop range including a stovetop 114 and a cooking chamber 116. The cooking chamber 116 and stovetop 114, when operated, can generate an exhaust fluid 118. The appliance 110 can include or otherwise be fluidly coupled to the ventilation system 112. The ventilation system 112 can include a suction source 120, a filter 122, and a duct 124 directly fluidly coupled to the ventilator 126.

The ventilator 126 is similar to the ventilator 26 in that it takes the exhaust fluid 118 and exhausts it exterior of the environment 130 or otherwise not into the interior 132. The ventilator 126, however, differs as the ventilator 126 can be formed as an Energy Recovery Ventilator (ERV), or a Heat Recovery Ventilator (HRV). The ERV can be defined as any suitable ventilator that transfers sensible heat as well as latent heat. The HRV can be defined as any suitable ventilator that transfers sensible heat.

At least a portion of the ventilator 126 is formed exterior the environment 130. The ventilator 126 can include a ventilator suction source 142 provided exterior of the environment 130. As a non-limiting example, the ventilator suction source 142 can be a fan or a pump provided exterior the environment. The ventilator suction source 142 can be configured to draw an inlet airflow 144. The inlet airflow 144 can be any suitable airflow such as, but not limited to, an ambient airflow from exterior the environment 130. A first heat exchanger 148 can be fluidly coupled to the ventilator suction source 142 and be configured to receive a first fluid flow 146 from the ventilator suction source 142. The first heat exchanger 148 can be any suitable heat exchanger. As a non-limiting example, the first heat exchanger 148 can be a ground heat exchanger provided underground and configured to transfer heat between the ground or soil and the first fluid flow 146. The first heat exchanger 148 can be provided underground a certain depth such that the soil surrounding the first heat exchanger 148 can be between 50° F. and 60° F. year round. As such, the first heat exchanger 148 can be generally defined as a heat exchanger configured to transfer heat between the first fluid flow 146 and an environment between 50° F. and 60° F. A second heat exchanger 152 can be provided within the interior 132 of the environment 130. The second heat exchanger can be fluidly coupled to the first heat exchanger 148 and a second fluid flow 150 defined as an output of the first heat exchanger 148 and an input in or inlet fluid flow into the second heat exchanger 152. The second heat exchanger 152 can further be fluidly coupled to the ventilation system 112 and be configured to receive a third fluid flow 156 from the ventilation system 122. The third fluid flow 156 can include at least a portion of the exhaust fluid 118.

During operation, the inlet airflow 144 can be drawn in through the ventilator suction source 142 and define at least a portion of the first fluid flow 146. The first fluid flow 146 can flow into the first heat exchanger 148 at a first temperature and transfer heat with the area surrounding the first heat exchanger 148. The second fluid flow 150 can exit the first heat exchanger 148 at a second temperature and flow into the second heat exchanger 152. The third fluid flow 156 from the ventilation system 112 can be at a third temperature and be fluidly coupled to the second heat exchanger 152. When in the second heat exchanger 152, heat can be exchanged between the second fluid flow 150 and the third fluid flow 156. The third fluid flow 156 can exit the second heat exchanger 152, after having transferred heat with the second fluid flow 150, as an outlet fluid flow 134. The second fluid flow 150 can exit the second heat exchanger 152, after having transferred heat with the third fluid flow 156, as a fourth fluid flow 154 at a fourth temperature. The fourth fluid flow 154, which is free of contaminates (e.g., VOCs) and defined by an ambient air source, can flow into the interior 132 of the environment 130 and define a fresh air source for the environment 130. Further, the interior 132 can be at a fifth temperature, which can be lower or higher than the fourth fluid flow 154. As a non-limiting example, the fifth temperature can be lower than the fourth temperature such that the fourth fluid flow defines a heating fluid flow for the environment 130. As a non-limiting example, the fifth temperature can be higher than the fourth temperature such that the fourth fluid flow defines a cooling fluid flow for the environment 130.

It will be appreciated that the first temperature can be dependent on a temperature of the fluid (e.g., atmosphere) exterior the environment 130. As a non-limiting example, the first temperature can be higher than the temperature of the area surrounding the first heat exchanger 148. As such, heat can be transferred from the first fluid flow 146 and into the area surrounding the first heat exchanger 148. As such, the first fluid flow 146 can be cooled such that the first temperature is larger than the second temperature. As a non-limiting example, the first temperature can be smaller than the temperature of the area surrounding the first heat exchanger 148. As such, heat can be transferred from the area surrounding the first heat exchanger 148 and into the first fluid flow 146. As such, the first fluid flow 146 can be heated such that the first temperature is smaller than the second temperature. Similarly, the second temperature can be smaller than the third temperature such that the second fluid flow 150 is heated as it flows through the second heat exchanger 152. As such, the fourth temperature can be larger than the second temperature. As such, waste heat from the exhaust fluid 118 is recaptured by transferring it to the second fluid flow 150 and outputting it into the environment 130 as the fourth fluid flow 154. It will be further appreciated that the ventilator 126 can include additional heating or cooling elements to further heat or cool the fourth fluid flow 154 to a desired level prior to it entering the interior 132. As a non-limiting example, the ventilator 126 can include third heat exchanger thermally coupled to a refrigerant or coolant configured to transfer heat with the fourth fluid flow 154.

It will be appreciated that the inlet airflow 144, the first fluid flow 146, the second fluid flow 150, the third fluid flow 156, the fourth fluid flow 154, and the outlet fluid flow 134 can all be defined by their contaminants. As used herein, the term "contaminants", or iterations thereof, can refer to compounds or elements that would be harmful if ingested or otherwise unwanted to be ingested by a person or animal. As a non-limiting example, contaminants can include VOCs. A contamination of the inlet airflow 144 can be dependent on the contamination of the air surrounding the ventilator suction source 142. As a non-limiting example, the air surrounding the ventilator suction source 142 can contain pollution. As such, the ventilator 126 can include at least one filter (not illustrated) configured to remove at least a portion of the contaminants from the inlet airflow 144. A contamination of the first fluid flow 146, the second fluid flow 150, and the fourth fluid flow 154 can all be defined by the contamination of the inlet airflow 144, or the contamination of the inlet airflow 144 after at least a portion of its contaminants has been removed. As discussed herein, the third fluid flow 156 and the outlet fluid flow 134 can include at least a portion of the exhaust fluid 118, which can include VOCs. The heat exchanger 152 can be configured such that the third fluid flow 156 is only thermally coupled, and not fluidly coupled, to the second fluid flow 150. As such, contaminants (e.g., exhaust fluid 118) from the third fluid flow 156 and the outlet fluid flow 134 are not transferred to the second fluid flow 150 or the fourth fluid flow 154. As such, the fourth fluid flow 154 can be defined as a clean fluid flow, while the outlet fluid flow 134 can be defined as a dirty fluid flow.

Figure 3:
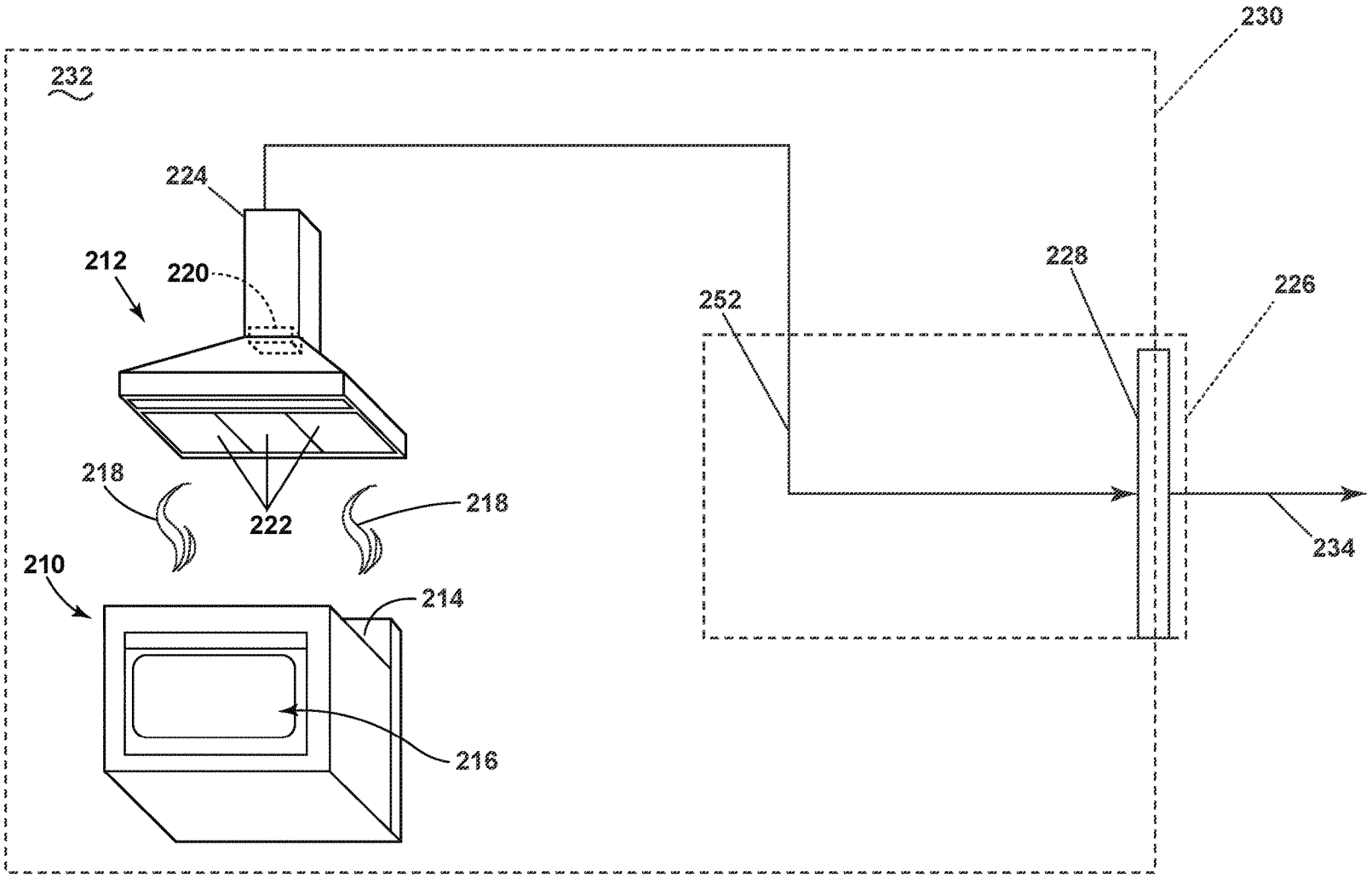
FIG. 3 is a schematic representation of an exemplary environment including an exemplary ventilator suitable for use as the ventilator of FIG. 1, the exemplary ventilator including a biowall.

FIG. 3 is a schematic representation of an exemplary environment 230 including an exemplary ventilator 226 suitable for use as the ventilator 26 of FIG. 1. The ventilator 226 and the environment 230 are similar to the ventilator 26, 126 and environment 30, 130, respectively, therefore, like parts will be identified with like numerals increased to the 300 series, with it being understood that the description of the like parts of ventilator 26, 126 and the environment 30, 130 applies to the ventilator 226 and the environment 230, respectively, unless otherwise noted.

An appliance 210 and a ventilation system 212 for the appliance 210 can be provided within an interior 232 of the environment 230. The appliance 210, as illustrated, is a stovetop range including a stovetop 214 and a cooking chamber 216. The cooking chamber 216 and stovetop 214, when operated, can generate an exhaust fluid 218. The appliance 210 can include or otherwise be fluidly coupled to the ventilation system 212. The ventilation system 212 can include a suction source 220, a filter 222, and a duct 224 directly fluidly coupled to the ventilator 226.

The ventilator 226 can be similar to the ventilator 26, 126, except the ventilator 226 can include a biowall 228. The biowall 228 can be defined as any wall or structure within or operably coupled to the environment 230, or otherwise fluidly coupled to the exhaust fluid 218 and including at least one biological element such as, but not limited to, soil, moss, plants, fungi, or any combination thereof. The biological element can be defined as any suitable living element that can filter out contaminants from a fluid flow around the biological element through a biological or filtering process. As such, the biological element can be defined as a biological filter. As noted, the biowall 228 can be fluidly coupled to a fluid flow 252 including at least a portion of the exhaust fluid 218.

During operation of the appliance 210 and the ventilator 226, the fluid flow 252 can flow through at least one biological element within the biowall 228. The biological element can filter or otherwise remove the contaminants from the fluid flow 252 such that the outlet fluid flow 234 is defined as a fluid flow without contaminants form the fluid flow 252. As illustrated, the outlet fluid flow 234 can be exhausted exterior the environment 230. It will be appreciated, however, that since the contaminants are removed from the fluid flow 252 when it flows through or around the biological element, that the outlet fluid flow 234 can be exhausted into the environment 230.

Benefits of the present disclosure include an appliance with a decreased install burden or install cost when compared to conventional appliances. For example, conventional appliances that require a ventilation system can require that alterations be made the environment that the conventional appliance is placed within. In other words, conventional appliances rely on a stand-alone ventilation system that must exhaust the exhaust fluid to an exterior of the environment. However, in order to get to the exterior of the environment, alterations must be made to the environment itself. For example, one may have to cut through a wall or install ducts in order to exhaust the exhaust fluid exterior the environment. That, or the conventional appliance itself must include various filters to filter out the contaminants from the exhaust fluid. All of the preceding can result in an increased burden of install, manufacture, or overall cost of the install/appliance. The appliance as described herein, however, includes a ventilation system that can be directly fluidly coupled to an existing ventilator of the environment (e.g., the ERV, HRV, or biowall). This, in turn, means that there is little to no install burden or manufacture difficulty (e.g., no extra filters are needed within the appliance) when compared to conventional appliances. This ultimately reduces the cost of the appliance or the install of the appliance when compared to the cost of the conventional appliance or the install of the conventional appliance.

To the extent not already described, the different features and structures of the various embodiments can be used in combination with each other as desired. That one feature is not illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A ventilation system for an appliance, the appliance being configured to generate an exhaust fluid when used, the appliance being provided within an interior of an environment, the ventilation system comprising:

a suction source configured to be in fluid communication with the appliance and configured to draw in the exhaust fluid into the ventilation system;

a ventilator located within the environment, the ventilator being a biological ventilator defined by a biowall provided within the interior or along an exterior of the environment; and a duct directly fluidly coupling the suction source to the ventilator.

2. The ventilation system of claim 1, wherein the biowall includes a connection with the duct, which transfers the exhaust fluid from the appliance to the biowall, the connection defining an inlet to the biowall.

3. The ventilation system of claim 2, wherein the biowall is configured to remove contaminants from the exhaust fluid.

4. The ventilation system of claim 3, wherein an outlet of the biowall is defined by an outlet fluid flow defined by no contaminants.

5. A ventilation system for an appliance, the appliance being configured to generate an exhaust fluid when used, the appliance being provided within an interior of an environment, the ventilation system comprising:

a suction source configured to be in fluid communication with the appliance and configured to draw in the exhaust fluid into the ventilation system;

a ventilator located within the environment, the ventilator being a Heat Recovery Ventilator (HRV) comprising: an inlet fluidly coupled to an atmosphere comprising an external air source with respect to the interior of the environment, the inlet defining an inlet fluid flow, a ground heat exchanger directly fluidly coupled to the inlet configured to exchange heat between the inlet fluid flow and a ground beneath or surrounding the environment, and a heat exchanger comprising:

a first inlet in fluid communication with the ground heat exchanger and the inlet fluid flow;

a first outlet in fluid communication with the interior of the environment;

a second inlet in fluid communication with the ventilator and the exhaust fluid; and a second outlet in fluid communication with the atmosphere; and a duct directly fluidly coupling the suction source to the ventilator.

6. The ventilation system of claim 5, wherein the heat exchanger is configured to heat the inlet fluid flow by transferring heat from the exhaust fluid to the inlet fluid flow.

7. The ventilation system of claim 5, wherein the appliance is at least one of a stovetop range, a dishwasher, a dryer, or a microwave.

8. The ventilation system of claim 7, wherein the appliance is a stovetop range and the suction source is provided within a range hood.

9. The ventilation system of claim 5, wherein the ventilator is an existing ventilator within the environment.

10. The ventilation system of claim 9, wherein the appliance is a range and the suction source is provided within a range hood.

11. The ventilation system of claim 10, wherein the range hood is directly coupled to the duct.

12. The ventilation system of claim 11, wherein the duct is at least partially formed within the existing ventilator.

* * * * *